United States Patent [19]

Healy

[11] Patent Number: 4,945,961

[45] Date of Patent: Aug. 7, 1990

[54] WALLET ATTACHMENT FOR FACILITATING WITHDRAWAL FROM A POCKET

[76] Inventor: William C. Healy, 2634 N. Lake Dr., Milwaukee, Wis. 53211

[21] Appl. No.: 374,442

[22] Filed: Jun. 30, 1989

[51] Int. Cl.[5] ..... A45C 1/06; A45C 11/18; A45C 13/30

[52] U.S. Cl. ..... 150/132; 150/134; 150/147; 206/37; 206/39

[58] Field of Search ..... 150/133, 134, 138, 147, 150/143, 149, 150, 136, 137; 206/37.1, 38.1, 37, 39; D3/61

[56] References Cited

U.S. PATENT DOCUMENTS

| | | | |
|---|---|---|---|
| D. 117,390 | 10/1939 | Buxton | D3/61 |
| 1,014,104 | 1/1912 | Walsh | 150/143 X |
| 1,513,383 | 10/1924 | Fleischer | 150/134 X |
| 2,419,092 | 4/1947 | Schupbach et al. | 150/138 |
| 2,540,422 | 2/1951 | Broughton | 150/143 X |
| 2,834,389 | 5/1958 | Major | 150/134 |
| 3,003,532 | 10/1961 | Nelson | 150/134 |
| 3,032,088 | 5/1962 | Stonebraker | 150/134 |
| 3,596,757 | 8/1971 | Cocchiaraley | 150/137 X |
| 3,822,446 | 7/1974 | Silverstein | 150/134 X |
| 4,002,194 | 1/1977 | Wright, SR. | 150/134 |
| 4,705,086 | 11/1987 | O'Neill | 150/134 |

FOREIGN PATENT DOCUMENTS

| | | | |
|---|---|---|---|
| 563473 | 12/1923 | France | 150/134 |
| 308386 | 9/1955 | Switzerland | 150/136 |
| 114898 | 4/1918 | United Kingdom | 150/134 |
| 335027 | 9/1930 | United Kingdom | 150/143 |
| 383916 | 11/1932 | United Kingdom | 150/149 |
| 629250 | 9/1949 | United Kingdom | 150/143 |
| 666585 | 2/1952 | United Kingdom | 150/134 |

*Primary Examiner*—Sue A. Weaver

*Attorney, Agent, or Firm*—Andrus, Sceales, Starke & Sawall

[57] ABSTRACT

A conventional billfold or wallet includes a strap or other type of prehensible attachment on or adjacent the center fold line of the wallet which may be grasped when the wallet is inserted in a pocket with its fold line disposed on top to facilitate withdrawal of the wallet therefrom. A narrow, continuous wallet encircling strap is preferably disposed to pass through the currency pocket for ready attachment to any conventional wallet without the need for any structural modification thereof whatever.

8 Claims, 2 Drawing Sheets

WALLET ATTACHMENT FOR FACILITATING WITHDRAWAL FROM A POCKET

BACKGROUND OF THE INVENTION

The present invention relates to wallets or billfolds and is directed particularly to means for facilitating the withdrawal of a wallet which is carried in a pocket.

Wallets or billfolds come in a wide variety of shapes and sizes, but the kind most commonly used and the one from which the name "billfold" is derived is the type which is adapted to be folded in half about a center fold line to facilitate insertion into a pocket for carrying. Wallets used by men are commonly of this type and are often carried in a rear pants pocket. More recently, wallets have been designed to accommodate the carrying of credit cards, in addition to currency, photos, ID cards, and the like also typically carried in a billfold. A typical construction may include a series of spaced parallel slots on one or both sides of the folded interior half faces of the wallet into which as many as 12 or more credit cards may be carried in a sort of shingled arrangement. Such an accumulation of credit cards adds considerably to the bulk and thickness of a wallet or billfold and, as a result, wallets often become increasingly more difficult to withdraw from a pants pocket, particularly a rear pocket. Therefore, some means of facilitating withdrawal of a substantially full and thick wallet from a pocket would be desirable.

U.S. Pat. Des. No. 160,147 discloses a combination purse or wallet to which a key holding chain is attached. The chain extends through a hole in the fold line at one end thereof to the interior of the wallet and exits through the opening between the folds to form a loop. If an attempt were made to withdraw this wallet from a pocket or similar repository by grasping and pulling on the chain, the edge location thereof would tend to cause the wallet to turn and orient it on a diagonal such that withdrawal would be further inhibited.

U.S. Pat. No. 3,165,135 discloses a money container which is particularly adapted to be inserted into the currency pocket of a wallet or separately attached to a wearer's body or a piece of clothing where it is concealed. The container includes integral tabs attached to the opposite ends of the container when it is unfolded which tabs are particularly adapted to secure the container in a wallet or to accommodate some type of attachment means, such as a safety pin, for attaching the container as indicated.

U.S. Pat. No. 3,387,641 shows a billfold or paper currency holder which has a pair of loops attached to its opposed ends, in a manner similar to U.S. Pat. No. 3,165,135 previously discussed. When the container is folded about a center fold line, one loop may be inserted through the other and then attached to a button or the like to hold the currency holder in a concealed location on or within the clothes of the wearer. This currency holder is particularly intended to be hidden on the person and not in any pocket or other usual repository for money and the like.

SUMMARY OF THE INVENTION

The present invention is directed to a prehensible or finger-engageable withdrawal means disposed on the outside of a conventional wallet or billfold on or adjacent the fold line which may be grasped to facilitate withdrawal of the wallet from a pocket. The prehensible withdrawal means is particularly adapted for use on a conventional wallet folded in half about a center fold line such that it may be grasped at a position near the midpoint of the fold line to allow the wallet to be pulled upward in a generally straight line.

The withdrawal means may comprise a thin strap which completely encircles the wallet along the fold line and extends through the upper opening and lower hole typically provided for the currency pocket on the inside of the wallet. In lieu of a closed loop, the strap may also be folded around the edges of the wallet at both ends of the fold line and secured to an interior surface of the wallet. A somewhat similar narrow strap may also be attached transversely across the fold line and attached to the oppositely facing outer surface portions of the wallet immediately adjacent the fold line.

The withdrawal means may alternately comprise an upstanding tab attached to the wallet along the fold line. In a related embodiment, the tab may be provided with a thickened free upper edge to further facilitate grasping.

In lieu of a separate strap or tab, the withdrawal means may comprise a textured surface treatment on the oppositely facing outer surface portions of the wallet adjacent the center fold line. The textured surface may comprise a roughened or embossed area, or the like, adapted to enhance frictional engagement of the wallet by the fingers.

This strap or other separate prehensible means is preferably made of the same material as the wallet, such as leather. In the preferred embodiment of the wallet encircling strap, such a strap can be easily added to a wallet on a retrofit basis or removed therefrom by cutting if not desired.

DETAILED DESCRIPTION OF THE PREFERRED EMBODIMENT

Figure 1:
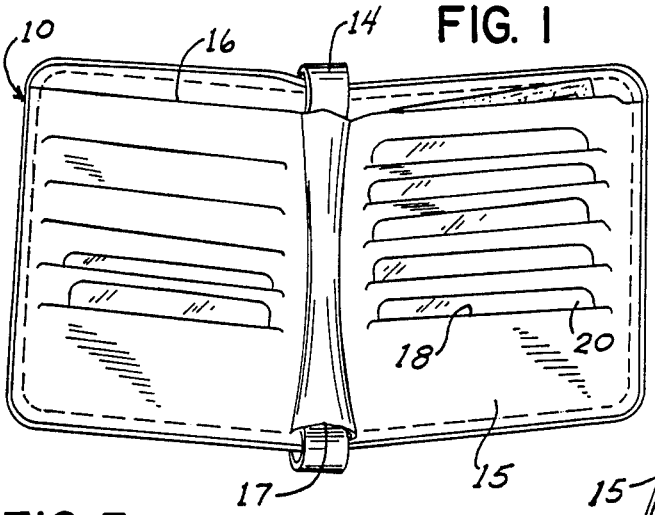
FIG. 1 is a plan view of the open interior of a wallet including the withdrawal means of the preferred embodiment of the present invention.
Figure 2:
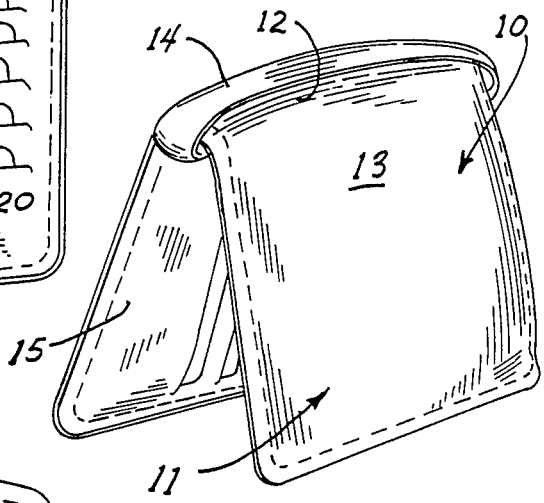
FIG. 2 is a perspective view of the wallet of FIG. 1 showing the wallet partly folded and the withdrawal strap attached thereto.

Each of the embodiments of the present invention, to be described in detail hereinafter, is adapted to be utilized on the same type of wallet 10 or any other wallet or billfold of a similar construction. Thus, the wallet 10 typically includes an outer surface layer 11 of a generally rectangular shape which is adapted to be folded in half about a center fold line 12 to define oppositely facing outer surface portions 13. A narrower strap 14 in the form of a continuous loop is positioned to encircle the wallet 10 generally along the fold line 12. Referring particularly to FIG. 1, the wallet 10 includes a conventional inner lining layer 15 which has an open upper edge 16 along the full length thereof to define a currency pocket and a small lower hole or opening 17 to facilitate folding, as is well known in wallet construction. The strap 14 is disposed to pass through the open upper edge 16 and the lower opening 17, the latter serving particularly to help retain the strap centered on the fold line 12. The inner lining 15 may include a series of parallel vertically spaces slots 18 into which credit cards 20 or the like may be inserted.

In lieu of a continuous loop, the strap 14 may be made somewhat shorter with its ends encircling the edges of the outer surface portion 13 at the ends of the fold line 12 and secured to the inside surface of the wallet in any convenient manner. The ends may, for example, be sewn, glued or riveted in position.

Figure 3:
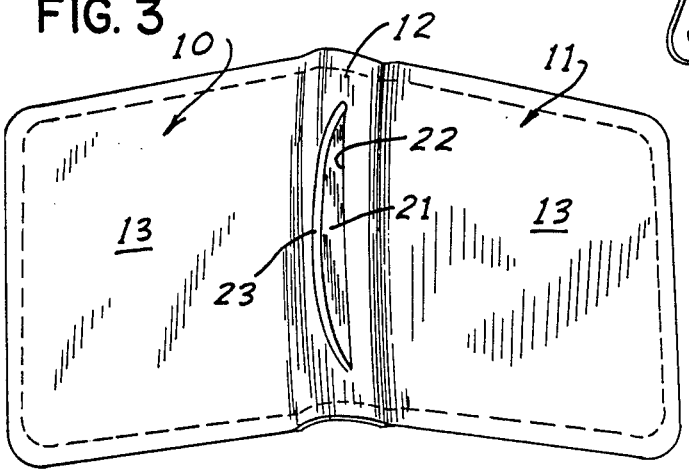
FIG. 3 is a plan view of the outer surface of an open wallet including a prehensible withdrawal means of another embodiment.
Figure 4:
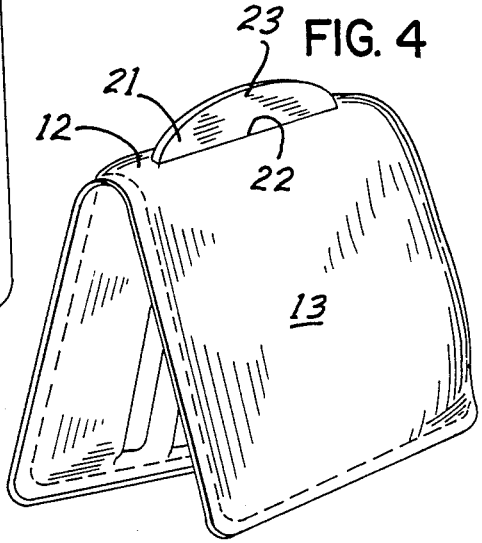
FIG. 4 is a perspective view showing the wallet of FIG. 3 in a partially folded position.

Referring to FIGS. 3 and 4, an alternate embodiment of the invention comprises a tab 21 which is attached to the wallet 10 along the fold line 12. The tab 21 is preferably attached to the wallet by inserting its lower edge through a slit 22 formed on the fold line and suitably securing the lower edge of the tab (not shown) to the inside surface of the wallet. The tab 21 is preferably of an arcuate shape and disposed with its region of maximum width 23 at the longitudinal center of the fold line 12. The tab 21 is also preferably attached to the wallet to extend generally perpendicularly from the outer surface 11 so it is in a position most readily grasped when the wallet is disposed in a pocket with the fold line on top.

Figure 5:
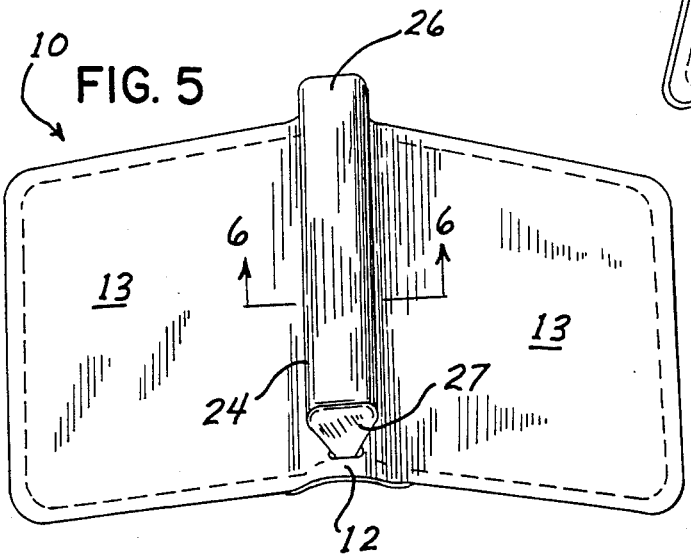
FIG. 5 is a plan view of the outer surface of an open wallet including a prehensible withdrawal means of another embodiment.
Figure 6:
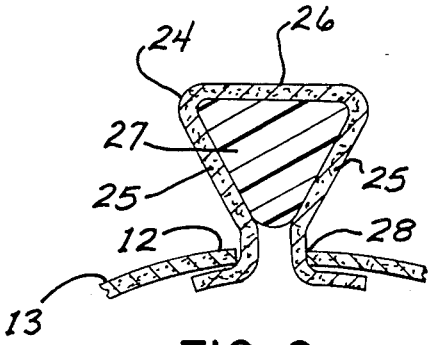
FIG. 6 is an enlarged view taken on line 6—6 of FIG. 5.

Another embodiment of the invention, similar to that shown in FIGS. 3 and 4 is depicted in FIGS. 5 and 6. In this embodiment, a tab 24 includes two layers 25 of material which are adapted to provide a free outer edge 26 having a region of enhanced thickness to further facilitate grasping. The region of enhanced thickness may be provided by material layers which are thicker at this point or, as shown, by inserting a rigid elongate member 27 between the layers 25. The tab 24 is of generally rectangular shape, as best shown in FIG. 6, and the elongate member 27 extends generally the full length thereof and is parallel to the fold line 12. As shown, the tab layers 25 actually comprise a single looped piece with the lower edges of the layers attached to the wallet along the fold line 12 in any convenient manner. For example, a slit 28, similar to slit 22, may be provided in the fold line with the tab inserted therethrough for attachment to the inside of the wallet.

Figure 7:
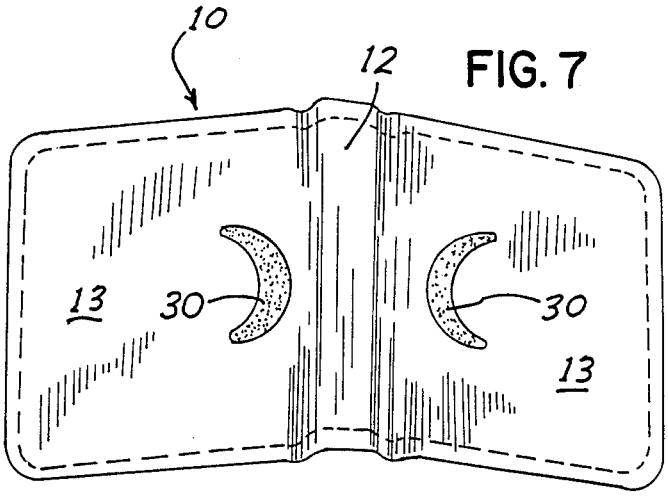
FIG. 7 is a plan view of the outer surface of an open wallet including a prehensible withdrawal means of another embodiment.
Figure 8:
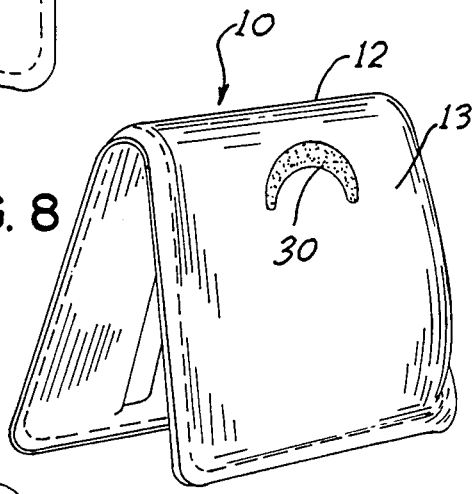
FIG. 8 is a perspective view showing the wallet of FIG. 7 in a partially folded position.

The prehensible withdrawal means shown in FIGS. 7 and 8 comprises an embossed area 30 formed in each of the outer surface portions 13 on opposite sides of the fold line 12. As shown, the embossed areas 30 are generally crescent shaped and are located to be readily engaged by the thumb and finger of the user to help prevent slipping and facilitate withdrawal of the wallet from a pocket. Of course, the embossed areas 30 may be of any convenient size and shape, with the crescent shape being only exemplary. The embossed areas are centered longitudinally along the fold line 12 and equally spaced therefrom. Any other type of textured or roughened surface area may also be utilized which will enhance finger engagement and help prevent slipping.

Figure 9:
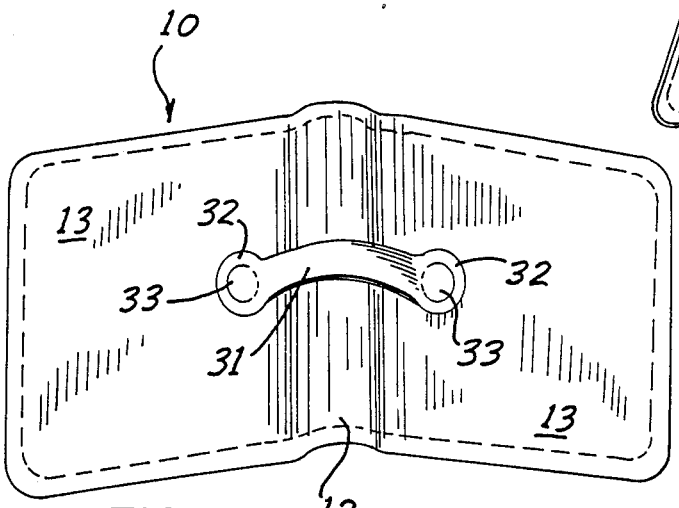
FIG. 9 is a plan view of the outer surface of an open wallet including a prehensible withdrawal means of another embodiment.
Figure 10:
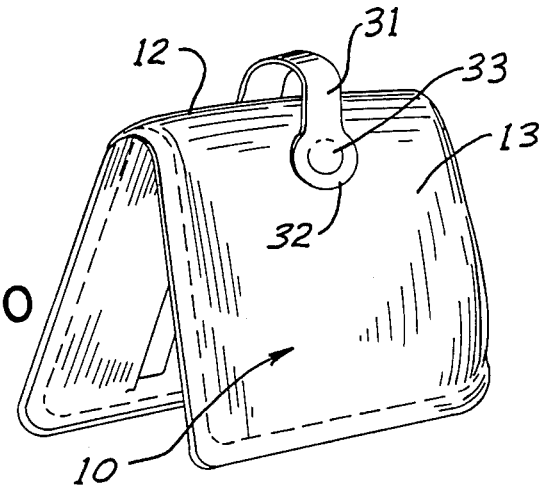
FIG. 10 is a perspective view showing the wallet of FIG. 9 in a partially folded position.

In the last embodiment shown in FIGS. 9 and 10, a short, narrow strap 31 is disposed transversely of the fold line 12 and has its opposite ends 32 attached directly to the outer surface portions 13 closely adjacent the fold line. The strap 31 is located approximately on the longitudinal center of the fold line 12 and may be secured to the wallet with rivets 33 or any other suitable means of fastening, including sewing, adhesives, or the like. The strap 31 is preferably made longer than the distance between the points of attachment of the strap ends 32 over the outer surface layer 11 of the wallet. In this manner, the center of the strap will always be raised slightly above the fold line such that it may be readily grasped for withdrawal of the wallet.

Various modes of carrying out the present invention are contemplated as being within the scope of the following claims particularly pointing out and distinctly claiming the subject matter which is regarded as the invention.

I claim:

1. In a pocket-size wallet of the type adapted to be folded in half about a center fold line in its outer surface layer to define oppositely facing outer surface portions, said wallet intended for insertion into a pocket with the center fold line at the upper edge of the wallet and nearest the pocket opening, the improvement comprising flexible finger-engageable withdrawal means on the outside of the wallet, formed indepenently of the outer surface layer, and adjacent the fold line for facilitating withdrawal of the wallet from a pocket, said withdrawal means comprising a narrow strap of a material the same as said outer layer, said strap extending along and generally parallel to said fold line.

2. The invention as set forth in claim 1 wherein the material comprises leather.

3. In a pocket-size wallet of the type adapted to be folded in half about a center fold line in its outer surface layer to define oppositely facing outer surface portions and having an inner lining, said wallet intended for insertion into a pocket with the center fold line at the upper edge of the wallet and nearest the pocket opening, the improvement comprising flexible finger-engageable withdrawal means on the outside of the wallet, formed independently of the outer surface layer, and adjacent the fold line for facilitating withdrawal of the wallet from a pocket, said withdrawal means comprising a narrow strap encircling the wallet in a continuous loop extending along and generally parallel to said fold line, the portion of said loop disposed on the inside of the wallet lying between said outer layer and said lining.

4. In a pocket-size wallet of the type adapted to be folded in half about a center fold line in its outer surface layer to define oppositely facing outer surface portions, said wallet intended for insertion into a pocket with the center fold line at the upper edge of the wallet and nearest the pocket opening, the improvement comprising flexible finger-engageable withdrawal means on the outside of the wallet, formed independently of the outer surface layer, and adjacent the fold line for facilitating withdrawal of the wallet from a pocket, said withdrawal means comprising a tab attached to the wallet on the fold line and extending therealong, said tab including an outer free edge opposite its attachment comprising a region of enhanced thickness.

5. The invention as set forth in claim 4 wherein said tab comprises two layers and said region of enhanced thickness comprises an elongate member disposed between said layers along the outer edge of the tab.

6. In a pocket-size wallet of the types adapted to be folded in half about a center fold line in its outer surface layer to define oppositely facing outer surface portions, said wallet intended for insertion into a pocket with the center fold line at the upper edge of the wallet and nearest the pocket opening, the improvement comprising flexible finger-engageable withdrawal means on the outside of the wallet, formed independently of the outer surface layer, and adjacent the fold line for facilitating withdrawal of the wallet from a pocket, said withdrawal means comprising a strap disposed transversely of and over the fold line and having opposite ends attached to said outer surface portions.

7. The invention as set forth in claim 6 wherein said strap is disposed at approximately the center of said fold line.

8. The invention as set forth in claim 7 wherein said strap is longer than the distance over the outer layer of the wallet between the ends of said strap.

* * * * *